United States Patent [19]

Henry et al.

[11] 4,177,417

[45] Dec. 4, 1979

[54] REFERENCE CIRCUIT FOR PROVIDING A PLURALITY OF REGULATED CURRENTS HAVING DESIRED TEMPERATURE CHARACTERISTICS

[75] Inventors: Paul M. Henry, Chandler; William J. Lillis, Tempe, both of Ariz.

[73] Assignee: Motorola, Inc., Schaumburg, Ill.

[21] Appl. No.: 882,710

[22] Filed: Mar. 2, 1978

[51] Int. Cl.[2] ..... G05F 1/56

[52] U.S. Cl. ..... 323/4; 323/19

[58] Field of Search ..... 307/296, 297; 323/1, 323/4, 19; 330/199, 288, 297

[56] References Cited

U.S. PATENT DOCUMENTS

| | | | |
|---|---|---|---|
| 3,777,251 | 12/1973 | Cecil et al. | 323/4 |
| 3,908,162 | 9/1975 | Marley et al. | 323/1 X |
| 3,922,596 | 11/1975 | Cave et al. | 323/4 |
| 3,930,172 | 12/1975 | Dobkin | 323/4 X |

*Primary Examiner*—A. D. Pellinen

*Attorney, Agent, or Firm*—Maurice J. Jones, Jr.

[57] ABSTRACT

The circuit includes a reference cell having four NPN transistors with the base-to-emitter junctions thereof connected in a loop with a resistor. A separate bias circuit is connected to at least one of the transistors of the cell. The collector-to-emitter paths of a first pair of the transistors are connected in series and the collector-to-emitter paths of a second pair of the transistors of the cell are also connected in series. The configuration of the cell enables the emitter of one of the transistors thereof to drive a plurality of controlled NPN current supply transistors so that a reference current developed in the resistor can be provided to plurality of circuit points requiring a reference current of a regulated magnitude which has a predetermined temperature coefficient.

11 Claims, 2 Drawing Figures

REFERENCE CIRCUIT FOR PROVIDING A PLURALITY OF REGULATED CURRENTS HAVING DESIRED TEMPERATURE CHARACTERISTICS

BACKGROUND OF THE INVENTION

1. Field of the Invention

This invention relates to regulator circuits, and more particularly to regulator circuits for providing a plurality of currents having regulated magnitudes with desired temperature characteristics and which are suitable for being fabricated in monolithic integrated circuit form.

2. Discussion of the Prior Art

Present day electronic circuits and systems often require current supplies or sources which provide currents having regulated magnitudes that are independent of supply voltage but have a particular temperature coefficient. More particularly, it is sometimes desirable to utilize a current supply circuit providing a current with a magnitude that has a positive temperature coefficient and which varies directly with absolute temperature. The current can be exploited to cancel the negative temperature coefficient inherent in the PN junctions of a differential pair of transistors, for instance, so as to enable the provision of a composite differential amplifier that has a gain which remains substantially constant with temperature change. Since a single integrated circuit can include several such differential pairs, it can require a plurality of currents all having magnitudes with positive temperature coefficients which vary directly with absolute temperature. To solve this problem it is sometimes desirable to provide current references capable of operating a plurality of controlled current supplies, each of which provides a current to a different portion of an integrated circuit, for instance.

Prior art circuits or cells have been developed which are useful in generating reference signals having positive temperature coefficients. U.S. Pat. No. 3,908,162, "Voltage and Temperature Compensating Source" of Robert R. Marley et al, which is assigned to the same assignee as the subject application, and U.S. Pat. No. 3,930,172 of Robert C. Dobkin, each disclose circuits or cells for providing reference signals having desired temperature coefficients to some kinds of electrical loads. The reference cells disclosed by the aforementioned patents, if formed of NPN transistors are not suitable for individually and simultaneously driving a plurality of NPN current control transistors in some applications. NPN current supply transistors are usually preferred to PNP types in monolithic integrated circuits because monolithic NPN transistors have Betas which are much greater than the Betas of monolithic PNP transistors. Specifically, these prior art circuits rely on a plurality of NPN transistors having base-to-emitter junctions connected serially in a loop with each other and a resistor, such that the summation of the base-to-emitter voltages develop a desired output reference voltage across the resistor. Furthermore, the magnitudes of the collector currents of these transistors, which have their collector-to-emitter paths connected in series, must be equal. If these circuits are called upon to drive a plurality of NPN current supply transistors then large currents are drawn from the loop and the collector currents become unequal. Consequently the prior art reference circuits tend to function improperly when required to drive one of the most desirable types of loads.

SUMMARY OF THE INVENTION

One object of the present invention is to provide circuits or cells for generating reference signals having a desired temperature coefficient.

Another object of the present invention is to provide a supply circuit for developing a regulated current which has a positive temperature coefficient magnitude that varies directly with absolute temperature and which provides enough drive current for simultaneously operating a plurality of controlled current supplies having NPN transistors.

Still another object is to provide a current supply in accordance with the foregoing objects which is suitable for fabrication in integrated circuit form.

In brief, a current reference circuit of one embodiment provides an output current of a regulated magnitude which has a predetermined temperature coefficient. The circuit includes a bias portion and a reference cell. A plurality of bipolar transistors and a resistive element are included in the reference cell. At least one of the plurality of transistors of the reference cell is coupled to the bias circuit. The base-to-emitter junctions of the plurality of transistors are connected serially in a loop with one another and with the resistive element so that the summation of the base-to-emitter voltages thereof develop a reference current in the resistive element. The magnitudes of the collector currents of pairs of the plurality of transistors are equal to one another. The base-to-emitter voltages of the plurality of transistors oppose one another around the loop. Consequently, the reference current has a magnitude independent of the magnitude of the collector currents and proportional to both the ratio of the emitter areas of the transistors and to the absolute temperature of the transistors. A plurality of controlled current supplies are connected to the emitter of one of the plurality of transistors of the cell so that the reference current can be provided by each of the current supplies to a different current utilization circuit.

DETAILED DESCRIPTION OF THE PREFERRED EMBODIMENT

Figure 1:
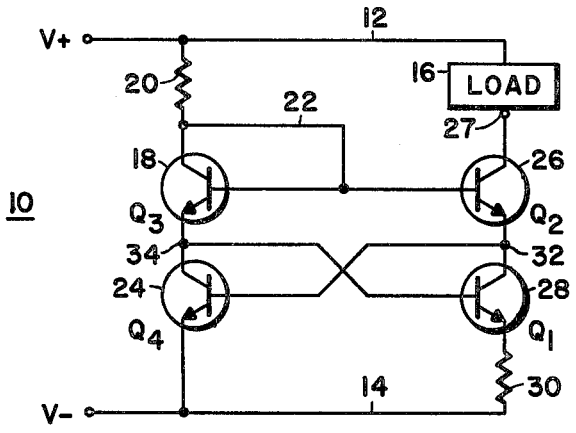
FIG. 1 (PRIOR ART)
FIG. 1 is a circuit diagram of a prior art current regulator.

FIG. 1 depicts a prior art current regulator circuit 10 which is disclosed by the aforementioned Dobkin patent. Circuit 10, which includes power supply conductors 12 and 14, provides a current of substantially constant magnitude to electrical load 16 even though the supply voltage across conductors 12 and 14 varies in magnitude assuming constant temperature. NPN transistor 18 includes a collector electrode which is connected both through resistor 20 to power supply conductor 12 and to the base electrode thereof through conductor 22. Thus, transistor 18 is connected as a diode and has substantially no current gain. The collector-to-emitter path of transistor 18 is connected in series with the collector-to-emitter path of NPN transistor 24 so that transistors 18 and 24 conduct equal main or collector currents.

NPN transistor 26 includes a collector electrode connected to terminal 27 of electrical load 16 and a base electrode connected to the base electrode of transistor 18. The collector-to-emitter path of transistor 26 is connected in series with the collector-to-emitter path of NPN transistor 28 so that transistors 26 and 28 conducts equal collector or main currents. The emitter electrode of transistor 24 is connected to supply conductor 14 and the emitter electrode of transistor 28 is connected through resistor 30 to supply conductor 14. The base electrode of transistor 24 is connected to junction 32 between the collector electrode of transistor 28 and the emitter electrode of transistor 26 and the base electrode of transistor 28 is connected to junction 34 between the emitter electrode of transistor 18 and the collector electrode of transistor 24. Resistor 20 drops the potential on conductor 12 to a desired value at the collector of transistor 18 and provides base drive for transistors 18 and 26 through conductor 22. The voltage developed across resistor 30 has a magnitude equal to the sum of the base-to-emitter voltages of transistors 26 and 24, less the sum of the base-to-emitter voltages of transistors 18 and 28. Since the collector currents of the transistors 18 and 24 are equal and the collector currents of transistors 26 and 28 are equal, the base-to-emitter voltages of each of the transistors is proportional to the emitter area thereof. If the emitter areas of transistors 18 and 24 are equal, their base-to-emitter voltages will cancel one another under these conditions. Accordingly, assuming that the emitter areas of transistors 26 and 28 are not equal or are scaled the voltage developed across resistor 30 will be equal to the difference between the base-to-emitter voltage of transistor 26 and the base-to-emitter voltage of transistor 28. The difference of the base-to-emitter voltages, $\Delta V_{BE}$ is defined by the following expression:

$$\Delta V_{BE} = \frac{nKT}{q} \quad \frac{J_{c2}}{J_{c1}} \tag{1}$$

$J_{c1}$ and $J_{c2}$ are the respective current densities of transistors 26 and 28. Current density is defined as the amount of current per unit area.

n=a number between 1 and 2 and is defined as the emission coefficient or injection level coefficient.

K=Boltzmann's constant

T=absolute temperature q=the magnitude of electronic charge

The magnitude of the output current of load 16 is equal to the magnitude of the current through resistor 30. Since $\Delta V_{BE}$ is developed across resistor 30, the magnitude of the output current varies with absolute temperature as desired.

Generally, the proper operation of circuit 10 depends on the fact that the magnitude of the collector currents of transistors 26 and 28 are equal to each other. If circuit 10 is required to control current supplies each including a NPN transistor having an emitter electrode connected to negative supply conductor 14 and a base electrode connected to the base of transistor 28, for instance, then the magnitudes of the collector currents in transistors 18 and 24 would not be equal. Consequently the magnitude of the output current wouldn't be the desired function of temperature. Thus circuit 10 can only effectively drive loads connected between conductor 12 and terminal 27. This restraint sometimes requires the use of PNP circuit supply transistors which are undesirable in monolithic circuits because of their low betas.

Figure 2:
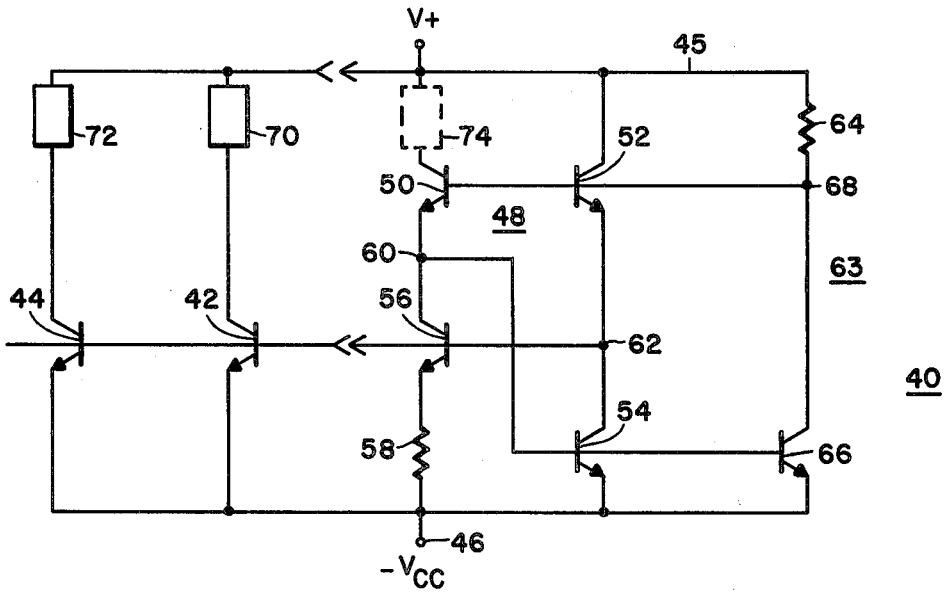
FIG. 2 is a circuit diagram of a current regulator constructed in accordance with the principles of the present invention.

Alternatively current supply circuit 40 of FIG. 2, which is one embodiment of the invention, is suitable for driving NPN current supply transistors 42, 44, etc. Such monolithic NPN transistors typically have betas in the range between 100 and 200. Current supply circuit 40 utilizes a positive power supply conductor 45 and a negative power supply conductor 46. Reference current generating cell 48 of circuit 40 includes NPN transistors 50, 52, 54 and 56. The collector-to-emitter paths of transistors 50 and 56 are connected in series with each other between power supply conductor 45 and one terminal of reference current resistor 58. Also, the collector-to-emitter paths of transistors 52 and 54 are connected in series with each other between positive power supply conductor 45 and negative power supply conductor 46. The base electrode of transistor 54 is connected to junction 60 between the collector and emitter electrodes of respective transistors 56 and 50. The base electrode of transistor 56 is connected to node 62 between the emitter electrode of transistor 52 and the collector electrode of transistor 54.

Thus, the base-to-emitter junctions of transistors 50, 52, 54, 56 and resistor 58 are all connected serially in a loop with one another. Beginning with negative supply conductor 46, the loop includes resistor 58, the emitter-to-base junction of transistor 56, the emitter-to-base junction of transistor 52, the base-to-emitter junction of transistor 50, and the base-to-emitter junction of transistor 54. The summation of the base-to-emitter voltages of these transistors is accumulated across resistor 58. The magnitude of the collector currents in transistors 50 and 56 are about equal and the magnitude collector currents in transistors 52 and 54 are about equal. By making the emitter area of transistor 56 larger than the emitter areas of transistors 50, 52 and 54, a voltage is developed across resistor 58 having a magnitude which varies directly with absolute temperature and a positive temperature coefficient.

Bias circuit 63 includes resistor 64 and the collector-to-emitter path of NPN transistor 66 which are connected in series between power supply conductors 45 and 46. Junction 68 between resistor 64 and collector electrode of transistor 66 is connected to the base electrodes of transistors 50 and 52. The base of transistor 66 is connected to the base of transistor 54. Resistor 64 and transistor 66 provide a bias potential for reference cell 48. Terminal 62 provides the output current of circuit 40.

Transistor 52 operates as an emitter-follower providing sufficient drive to terminal 62 to operate NPN current supply transistors 42, 44, etc. The collectors of the current supply transistors are connected to respective current utilization circuits 70 and 72 each of which requires a current having a magnitude with a positive temperature coefficient and which varies with absolute temperature. The base current for transistors 42 and 44 is represented by I'.

If the loop equations are solved for cell 48, then the voltage, $V_{58}$ across resistor 58 is expressed by the following equation:

$$V_{58} = \left( \ln N + \ln \frac{1}{1 + \frac{I'}{I_{E54}}} \right) \frac{nKT}{q} \tag{2}$$

where: N = ratio of the area of transistor 56 to the area of transistor 50. $I_{E54}$ is the emitter current of transistor 54.

In equation (2), the first term on the right side of the equal sign is the desired output and the right-hand term is the error term. As the value of I' is minimized, the undesired term on the right-hand side of the equation approaches zero. It is desired to minimize the value of amount of I' by utilizing high beta transistors such as current supply transistors 42 and 44 etc. Thus, the magnitude of any disruptions of the current of cell 48 caused by transistors 42 and 44 are reduced by the beta of transistor 52 as compared to disruptions caused by transistors 42 and 44 being connected to node 34 of circuit 10. Transistor 52 typically will have a beta in the range between 100 to 200. As can be seen from equation (2), the voltage across resistor 58, and hence the current therethrough, are proportional to the absolute temperature. Thus the magnitude of the current conducted by NPN current supply transistors 42 and 44 is proportional to absolute temperature and has a positive temperature coefficient. These output currents can be used to enable the gains of differential stages to be substantially constant over a temperature range or to cancel out undesired negative temperature coefficients normally associated with semiconductor junctions.

Resistor 64 and transistor 66 of circuit 40 develop a desired bias potential at terminal 68 for cell 48 thus eliminating the need for resistor 20 of circuit 10. The value of resistor 64 and the design of device 66 are such that transistor 66 conducts a current having about the same magnitude as the current conducted by transistor 54.

Emitter follower transistor 52 buffers the current source string including transistors 42 and 44 whereas diode 22 of FIG. 1 does not perform this function. This is because follower 52 provides current gain whereas the diode of circuit 10 configuration of FIG. 1 provides no current gain. A further electrical load 74 similar to load 16 driven by circuit 10 could be connected in the collector circuit of transistor 50 of circuit 10 as indicated by dashed lines.

What is claimed is:

1. A circuit for providing a plurality of output currents of a regulated magnitude which have a predetermined temperature coefficient, including in combination:

reference cell means having resistive means and a plurality of bipolar transistors each having an emitter, a base and a collector, the base-to-emitter junctions of said plurality of transistors being connected serially in a loop with one another and with said resistive means such that the summation of the base-to-emitter voltages thereof develops a reference current in said resistive means, the magnitudes of the collector currents of said plurality of transistors being substantially equal to one another, and the base-to-emitter voltages of pairs of said plurality of transistors opposing each other around said loop, such that said reference current has a magnitude which is substantially proportional to the ratio of the emitter areas of at least a pair of said plurality of transistors and to the absolute temperature of said transistors;

a plurality of controlled current supply means connected to said emitter of one of said plurality of transistors so that said one of said plurality of transistors operates as an emitter-follower for enabling the plurality of output currents to be provided by said plurality of controlled current supply means, said emitter of said one of said plurality of transistors being further coupled to the collector of another one of said plurality of transistors; and bias circuit means connected to said another one of said plurality of transistors for providing a bias voltage of a desired magnitude thereto and which enables said plurality of output currents to have the desired temperature coefficient.

2. The circuit of claim 1 wherein the emitter areas of at least two of said plurality of transistors are different from one another.

3. The circuit of claim 2 wherein said magnitude of said reference current is proportional to the ratio of the emitter areas of said at least two of said plurality transistors.

4. The circuit of claim 3 wherein said resistive means is coupled to the base-to-emitter junctions of adjacent ones of said plurality of transistors so that said reference current is available at said emitter of one of said plurality of transistors to provide the output current.

5. The circuit of claim 1 wherein:

said plurality of transistors includes a first pair of transistors having the collector-to-emitter paths thereof connected in series and a second pair of transistors having the collector-to-emitter paths thereof connected in series;

first circuit means connecting a junction between said first pair of transistors to the base of one of said second pair of transistors;

second circuit means connecting a junction between said second pair of transistors to a base of one of said first pair of transistors; and third circuit means connected between the base of the other one of said first pair of transistors and the base of the other one of said second pair of transistors.

6. The circuit of claim 5 wherein the collector electrodes of said other one of said first pair of transistors and said other one of said second pair of transistors are directly connected to a power supply conductor.

7. The circuit of claim 1 wherein said bias circuit means includes:

further resistive means; and bias transistor means connected with said further resistive means.

8. A circuit suitable for fabrication in monolithic integrated form, for providing a plurality of output currents of a regulated magnitude which have a predetermined temperature coefficient, including in combination:

reference cell means including a first pair of bipolar transistors having the collector-to-emitter paths thereof connected in series and a second pair of transistors having the collector-to-emitter paths thereof connected in series, first circuit means connected between a junction between said first pair of transistors and the base of one of said second pair of transistors, second circuit means connected between a junction between said second pair of transistors and the base of one of said first pair of transistors, third circuit means connected between the base of the other of said first pair of transistors and the base of the other of said second pair of transistors;

resistive means connected to the emitter of said one of said first pair of transistors;

a plurality of controlled current supply means connected to said emitter of said other of said second pair of transistors so that said other of said second pair of transistors operates as an emitter-follower for enabling a reference current to be developed in said resistive means, said reference current being provided by each of said plurality of controlled current supply means; and bias circuit means connected to said one of said second pair of transistors for providing a bias voltage of a desired magnitude thereto and which enables said reference current to have the desired temperature coefficient.

9. The circuit of claim 8 further including:

first power supply conductor means directly connected to said collector electrodes of said other transistors of said first and second pair of transistors; and second power supply conductor means connected to said resistive means and to said emitter electrode of said one of said second pair of transistors.

10. The circuit of claim 9 wherein said bias circuit means includes:

bias resistive means connected between said first power supply conductor means and the bases of the others of said first and second pairs of transistors; and bias transistor means having a collector electrode connected to said bias resistive means, a base electrode connected to said base electrodes of said ones of said transistors of said first and second pairs, and an emitter electrode connected to said second power supply conductor means.

11. The circuit of claim 9 wherein each of said plurality of controlled current supply means includes a transistor having an emitter electrode connected to said second power supply conductor means and a base electrode connected to said emitter electrode of said other transistor of said second pair of transistors.

* * * * *